US010794018B2

(12) United States Patent
Hirman et al.

(10) Patent No.: US 10,794,018 B2
(45) **Date of Patent: *Oct. 6, 2020**

(54) QUICK CHANGE MILLING ASSEMBLY FOR A COLD PLANER

(71) Applicant: Caterpillar Paving Products Inc., Brooklyn Park, MN (US)

(72) Inventors: Colton Hirman, Maple Grove, MN (US); Lucian Husar, Rogers, MN (US); Nathan L. Mashek, St. Michael, MN (US); Jason Robert Bjorge, Blaine, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/445,896

(22) Filed: Jun. 19, 2019

(65) Prior Publication Data

US 2019/0301111 A1 Oct. 3, 2019

Related U.S. Application Data

(63) Continuation of application No. 15/632,996, filed on Jun. 26, 2017, now Pat. No. 10,370,804.

(30) Foreign Application Priority Data

Jun. 30, 2016 (EP) ..... 16177224

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ..... E02F 3/3609; E02F 3/3636; E02F 3/3663; E01C 23/088; E01C 23/127
(Continued)

(56) References Cited

U.S. PATENT DOCUMENTS 4,928,386 A 5/1990 Schupp et al.
5,107,610 A * 4/1992 Fusco ..... E02F 3/3627 37/444

(Continued)

FOREIGN PATENT DOCUMENTS

CN 1182152 5/1998
JP 61087032 5/1986

OTHER PUBLICATIONS

"U.S. Appl. No. 15/632,996, Supplemental Notice of Allowability dated May 13, 2019", 4 pgs.

(Continued)

*Primary Examiner* — David J Bagnell
*Assistant Examiner* — Michael A Goodwin
(74) *Attorney, Agent, or Firm* — Schwegman, Lundberg & Woessner

(57) ABSTRACT

A milling assembly for a cold planer including a frame and an actuator assembly having a plurality of movable locking rods for mounting the milling assembly to the frame is disclosed. The milling assembly comprises a drum housing, and a plurality of mounting units fixed to the drum housing for mounting the milling assembly to the frame. The mounting units include a plurality of mounting holes configured to receive a respective end portion of one of the plurality of movable locking rods. In another embodiment, a milling assembly including an actuator assembly with movable locking rods is disclosed.

12 Claims, 5 Drawing Sheets

(58) Field of Classification Search
USPC ..... 414/686, 723; 37/468; 172/272, 273, 172/274
See application file for complete search history.

(56) References Cited

U.S. PATENT DOCUMENTS

| | | | | |
|---|---|---|---|---|
| 5,378,081 | A | 1/1995 | Swisher, Jr. | |
| 5,474,397 | A | 12/1995 | Lyons | |
| 6,227,620 | B1 | 5/2001 | Page | |
| 7,721,831 | B2 | 5/2010 | Smolders et al. | |
| 7,942,604 | B2 | 5/2011 | Willis et al. | |
| 8,770,668 | B2 | 7/2014 | Hall et al. | |
| 9,033,423 | B2 | 5/2015 | Darscheid et al. | |
| 9,951,483 | B2 | 4/2018 | Roetsch et al. | |
| 10,174,465 | B2 | 1/2019 | Steeg et al. | |
| 10,183,606 | B2 | 1/2019 | Schomaker et al. | |
| 2005/0103947 | A1* | 5/2005 | Beller | E01C 23/088 248/62 |
| 2007/0107274 | A1* | 5/2007 | Livesay | E02F 9/2833 37/468 |
| 2008/0292399 | A1* | 11/2008 | Freeburn | E01C 23/088 404/90 |
| 2010/0189535 | A1* | 7/2010 | Nye | E02F 3/3636 414/723 |
| 2010/0237681 | A1 | 9/2010 | Von et al. | |
| 2011/0280648 | A1* | 11/2011 | Malacrino | A01B 59/062 403/31 |
| 2012/0131783 | A1 | 5/2012 | Hall et al. | |
| 2012/0284989 | A1 | 11/2012 | Busley et al. | |
| 2013/0000996 | A1 | 1/2013 | Miller et al. | |
| 2016/0004037 | A1 | 1/2016 | Chen et al. | |
| 2016/0040371 | A1* | 2/2016 | Roetsch | E01C 23/088 299/39.4 |
| 2016/0040372 | A1 | 2/2016 | Eiden | |
| 2017/0107684 | A1 | 4/2017 | Dong | |
| 2017/0130407 | A1 | 5/2017 | Laux et al. | |
| 2017/0284039 | A1 | 10/2017 | Busley et al. | |
| 2017/0328018 | A1 | 11/2017 | Mannebach et al. | |
| 2018/0002876 | A1 | 1/2018 | Hirman et al. | |
| 2019/0136469 | A1 | 5/2019 | Steeg et al. | |

OTHER PUBLICATIONS

"European Application Serial No. 16177224.9, Extended European Search Report dated Sep. 29, 2016", 7 pgs.
"U.S. Appl. No. 15/632,996, Preliminary Amendment filed Jun. 26, 2017", 6 pgs.
"U.S. Appl. No. 15/632,996, Non Final Office Action dated Sep. 28, 2018", 14 pgs.
"U.S. Appl. No. 15/632,996, Notice of Allowance dated Mar. 20, 2019", 5 pgs.
"U.S. Appl. No. 15/632,996, Response filed Dec. 13, 2018 to Non Final Office Action dated Sep. 28, 2018", 9 pgs.

* cited by examiner

QUICK CHANGE MILLING ASSEMBLY FOR A COLD PLANER

CLAIM OF PRIORITY

This application is a continuation of U.S. patent application Ser. No. 15/632,996, filed on Jun. 26, 2017, which claims priority to European Application Ser. No. 16177224.9, filed on Jun. 30, 2016. The above applications are incorporated herein by reference in their entireties.

TECHNICAL FIELD

The present disclosure generally relates to a ground milling machine. More particularly, the present disclosure relates to a milling assembly of a cold planer.

BACKGROUND

Cold planers, sometimes called road mills or profilers, are powered machines used to remove at least part of a surface of a paved area such as a road, bridge, and a parking lot. Typically, cold planers include a frame, a power source, a milling assembly positioned below the frame, and a conveyor system. The milling assembly includes a rotatable drum having numerous cutting tools disposed thereon. As power from the power source is transferred to the milling assembly, this power is further transferred to the rotatable drum, thereby rotating the drum about its axis. As the drum rotates, its cutting tools engage hardened asphalt, concrete and other materials of an existing surface of a paved area, thereby removing layers of these existing structures. The spinning action of the cutting tools transfers these removed layers to the conveyor system which transports the removed material to a separate powered machine such as a haul truck for removal from a work site.

It may be desirable to remove the milling assembly from the frame, for example to allow transportation of the cold planer or to replace a worn or damaged milling assembly. Furthermore, it may be desirable to switch between milling assemblies having different widths.

US 2016/0040371 A1 discloses a ground milling machine comprising a replaceable milling drum unit. A fastening device is provided between the milling part and the machine part of the ground milling machine. The fastening device includes a form-fitting device with a pin protruding in the vertical direction, and a pin receptacle. The pin is disposed on the milling drum box and a pin receptacle is provided on the machine part. A pin is insertable in a form-fitting manner into the pin receptacle.

The present disclosure is directed, at least in part, to improving or overcoming one or more aspects of prior systems.

SUMMARY OF THE DISCLOSURE

In one aspect of the present disclosure, a milling assembly for a cold planer including a frame and an actuator assembly having a plurality of movable locking rods for mounting the milling assembly to the frame is disclosed. The milling assembly comprises a drum housing, and a plurality of mounting units fixed to the drum housing for mounting the milling assembly to the frame. The mounting units include a plurality of mounting holes configured to receive a respective end portion of one of the plurality of movable locking rods.

In another aspect of the present disclosure, a milling assembly for a cold planer including a frame with a plurality of mounting units having mounting holes for mounting the milling assembly to the frame is disclosed. The milling assembly comprises a drum housing, and an actuator assembly fixed to the drum housing, and having a plurality of movable locking rods configured to engage with the mounting holes of the mounting units for mounting the milling assembly to the frame.

In yet another aspect, a ground milling machine, particularly a cold planer or a surface miner, is disclosed. The ground milling machine comprises a frame, and a milling assembly as exemplary disclosed herein. The end portions of the locking rods are received in mounting holes of the mounting units in a mounted state.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1:
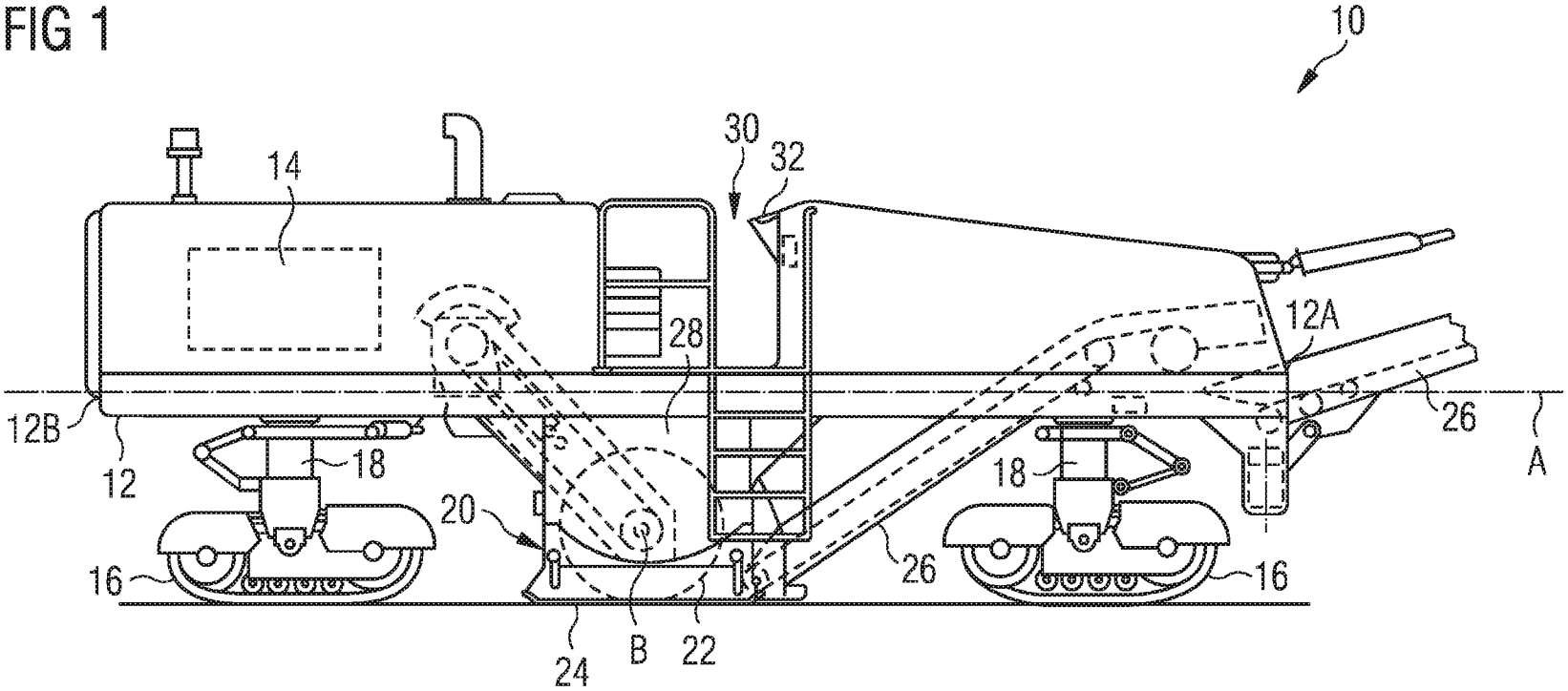
FIG. 1 is a side view of an exemplary cold planer constructed in accordance with the present disclosure.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure is based in part on the realization that a reliable and durable fastening of a replaceable milling assembly at a frame of a cold planer may include a plurality of movable locking rods engaging with mounting holes provided in mounting units fixed to the replaceable milling assembly or the frame. The mounting holes may be aligned with the movable locking rods. The mounting holes may extend in a horizontal direction. The mounting holes and/or the movable locking rods may include conical sections for properly positioning the milling assembly during the mounting procedure. Furthermore, for lifting the milling assembly into place, a plurality of lifting cylinders may be connectable to the milling assembly.

Referring now to the drawings, and with specific reference to FIG. 1, a cold planer is shown and generally referred to by reference numeral 10.

The cold planer 10 includes a frame 12, and a power source 14 connected to the frame 12. The frame 12 longitudinally extends between a first end 12A and a second end 12B along a frame axis A. The power source 14 may be provided in any number of different forms including, but not limited to, Otto and Diesel cycle internal combustion engines, electric motors, hybrid engines and the like.

The frame 12 is supported by transportation devices 16 via lifting columns 18. The transportation devices 16 may be any kind of ground-engaging device that allows to move the cold planer 10 in a forward direction over a ground surface, for example a paved road or a ground already processed by the cold planer 10. For example, in the shown embodiment, the transportation devices 16 are configured as track assemblies. The lifting columns 18 are configured to raise and lower the frame 12 relative to the transportation devices and the ground.

The cold planer 10 further includes a milling assembly 20 connected to the frame 12. The milling assembly 20 includes a rotatable milling drum 22 operatively connected to the power source 14. The milling drum 22 includes a plurality of cutting tools disposed thereon. The milling drum 22 can be rotated about a drum or housing axis B extending in a direction perpendicular to the frame axis A. As the rotatable milling drum 22 spins about its drum axis B, the cutting tools may engage hardened materials 24, such as, for example, asphalt and concrete, of existing roadways, bridges, parking lots and the like. Moreover, as the cutting tools, for example chisels, engage such hardened materials 24, the cutting tools remove layers of these hardened materials. The spinning action of the rotatable drum 22 and its cutting tools then transfers the hardened materials to a conveyor system 26.

The milling assembly 20 further includes a drum housing 28 accommodating the milling drum 22. The drum housing 28 includes front and rear walls, and a top cover positioned above the milling drum 22. Furthermore, the drum housing 28 includes lateral covers on the left and right sides of the milling drum 22 with respect to a travel direction of the cold planer 10. The drum housing 28 is open toward the ground so that the milling drum 22 can engage in the ground from the drum housing 28. Furthermore, the drum housing 28 can be removed from the frame 12 in a quick and easy manner which is described later on with reference to FIGS. 2 to 4.

The cold planer 10 further includes an operator station or platform 30 including an operator interface 32 for inputting commands to a control system (not shown) for controlling the cold planer 10, and for outputting information related to an operation of the cold planer 10.

The cold planer 10 may include further components not shown in the drawings or described above, which are not described in further detail herein. For example, the cold planer 10 may further include a fuel tank, a cooling system, a milling fluid spray system, various kinds of circuitry etc.

Figure 2:
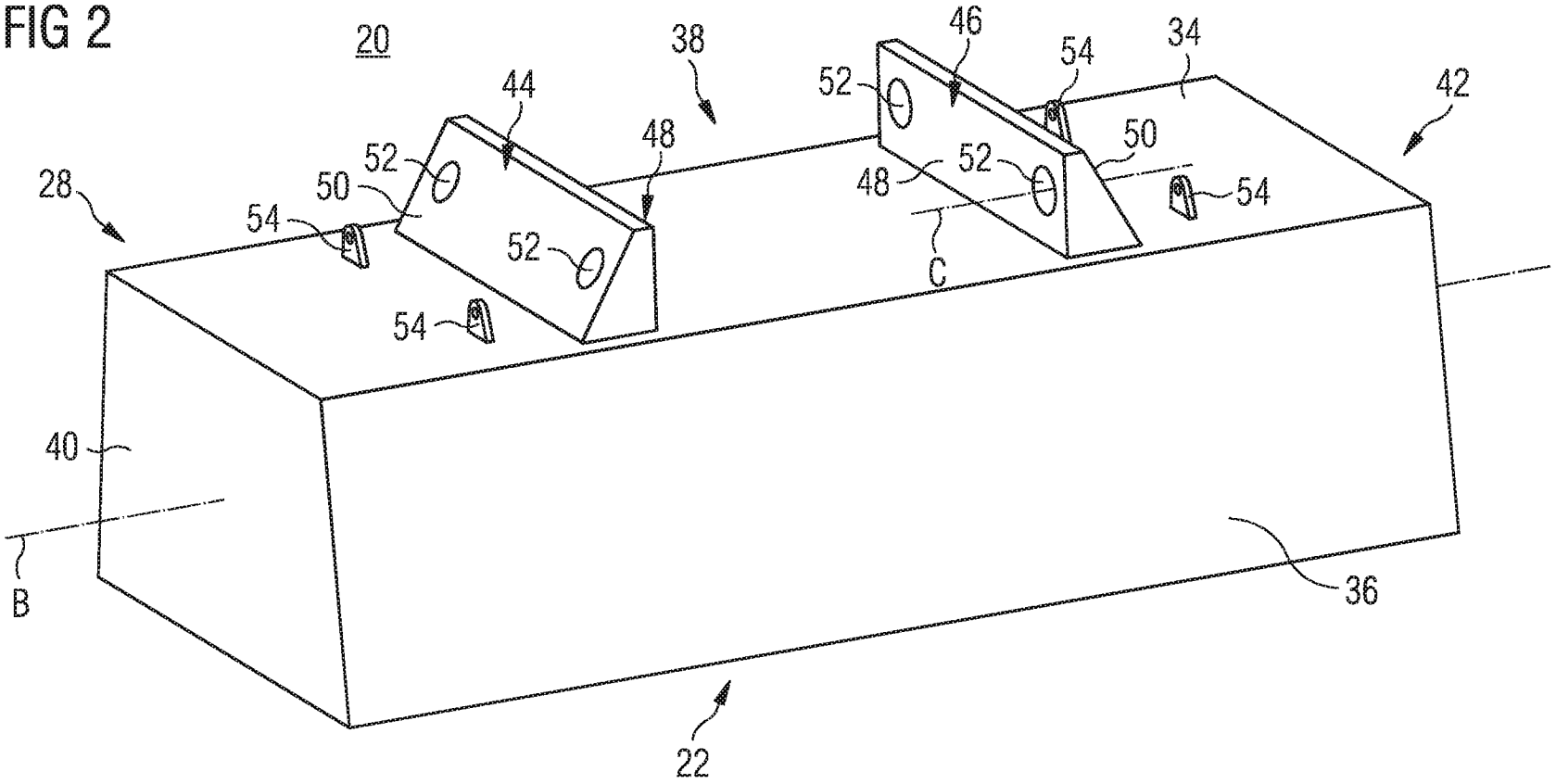
FIG. 2 is a perspective view of a schematic drawing of a milling assembly in accordance with the present disclosure.

Turning to FIG. 2, a perspective view of an exemplary milling assembly 20 is shown.

An outer periphery of the drum housing 28 is formed by a top face 34 facing the frame 12 in a mounted state of the milling assembly 20 (see FIG. 1). The drum housing 28 further includes a movable front face 36 and a movable rear face 38 oppositely directed to each other. The drum housing 28 includes as well, movable lateral faces 40 and 42 oppositely directed to each other. As noted herein, the drum housing 28 is open at a bottom side so that the milling drum 22 (see FIG. 1; covered in FIG. 2 by the top face 34, the front face 36, and the lateral face 40) can engage with the ground. The drum housing 28 longitudinally extends between the lateral faces 40 and 42 along a housing axis B that coincides with a drum axis of the milling drum 22.

The milling assembly 20 further includes a first mounting unit 44 and a second mounting unit 46 for mounting the milling assembly 20 to the frame 12 of the cold planer 10 (see FIG. 1). Both the first mounting unit 44 and the second mounting unit 46 are rigidly connected (fixed) to the top face 34 of the drum housing 28. In other embodiments, more than two mounting unit may be provided, and/or at least one mounting unit may be fixed to any one of the front face 36, the rear face 38, and the lateral faces 40 and 42.

In the shown embodiment, the first mounting unit 44 and the second mounting unit 46 are configured in a wedge profile. Specifically, the mounting units 44 and 46 are formed as wedge-shaped protrusions extending from the top face 34 of the drum housing 28 in a radial direction of the housing axis B. Each mounting unit 44, 46 includes a first face 48 extending in a virtual plane substantially perpendicular to the housing axis B. The first face 48 of the first mounting unit 44 faces the first face 48 of the second mounting unit 46. Additionally, each mounting unit 44, 46 includes a second face 50 opposing the first face 48. The second faces 50 are nonparallel to the first faces 48. Stated differently, the second faces 50 are inclined with respect to the first faces 48.

Furthermore, the mounting units 44, 46 include a plurality of mounting holes 52. The mounting holes 52 extend along respective first hole axes C (only one of which is shown in FIG. 2). The first hole axes C are parallel to the housing axis B. In other embodiments, for example, the first hole axes C may extend in any other direction extending in a virtual plane parallel to the housing axis (B). In other words, the first hole axes C may extend in a horizontal plane.

The mounting holes 52 may have a constant diameter, or may include a conical section for centering purposes as described in more detail later on. The mounting holes 52 are each configured to receive a rod end of a movable locking rod of an actuator assembly which is also described with reference to FIGS. 3 and 4 later on.

In the exemplary embodiment of FIG. 2, each mounting unit 44, 46 includes in total two mounting holes 52. The mounting holes 52 are formed as throughholes extending between the first face 48 and the second face 50 of the respective mounting unit 44, 46. Both mounting holes 52 of the first mounting unit 44 are aligned with both mounting holes 52 of the second mounting unit 46. The mounting holes 52 of each mounting unit 44, 46 are spaced apart with respect to each other in a direction along the frame axis A (see FIG. 1)). However, it is contemplated that, in other embodiments, each mounting unit may include more or less than in total two mounting holes, at least one mounting hole may be formed as a blind hole, and/or the mounting holes may not be aligned with each other. Additionally or alternatively, the mounting holes 52 of each mounting unit 44, 46 may be spaced apart with respect to each other in a vertical direction (in other words, in a direction perpendicular to both the frame axis A and the housing axis B).

Furthermore, in the shown embodiment, the first mounting unit 44 is arranged in a first half section of the top face 34 of the drum housing 28, and the second mounting unit 46 is arranged in a second (the other) half section of the top face 34 adjacent to the first half section in a direction along the housing axis B. Specifically, as can be seen in FIG. 2, the first mounting unit 44 and the second mounting unit 46 are symmetrically configured with respect to a virtual center plane of the drum housing 28, wherein the virtual center plane extends perpendicular to the housing axis B. In other embodiments, the mounting units may be provided in a non-symmetric configuration, and/or the first mounting unit may be arranged in a first half section of the top face of the drum housing, and the second mounting unit may be arranged in a second (the other) half section of the top face adjacent to the first half section in a direction perpendicular to the housing axis B.

The milling assembly 20 further includes a plurality of (four in the shown embodiment) pin receptions 54 fixed to the top face 34 of the drum housing 28. As described in more detail later on, the pin receptions 54 are configured to receive a pin for connecting a locking rod of a lifting cylinder to the drum housing 28 for lifting the milling assembly 20 into place. For example, the pin receptions 54 may be provided symmetrically with respect to a virtual enter plane extending perpendicular to the housing axis B. It is noted that, in other embodiments, the pin receptions 54 may be omitted.

Figure 3:
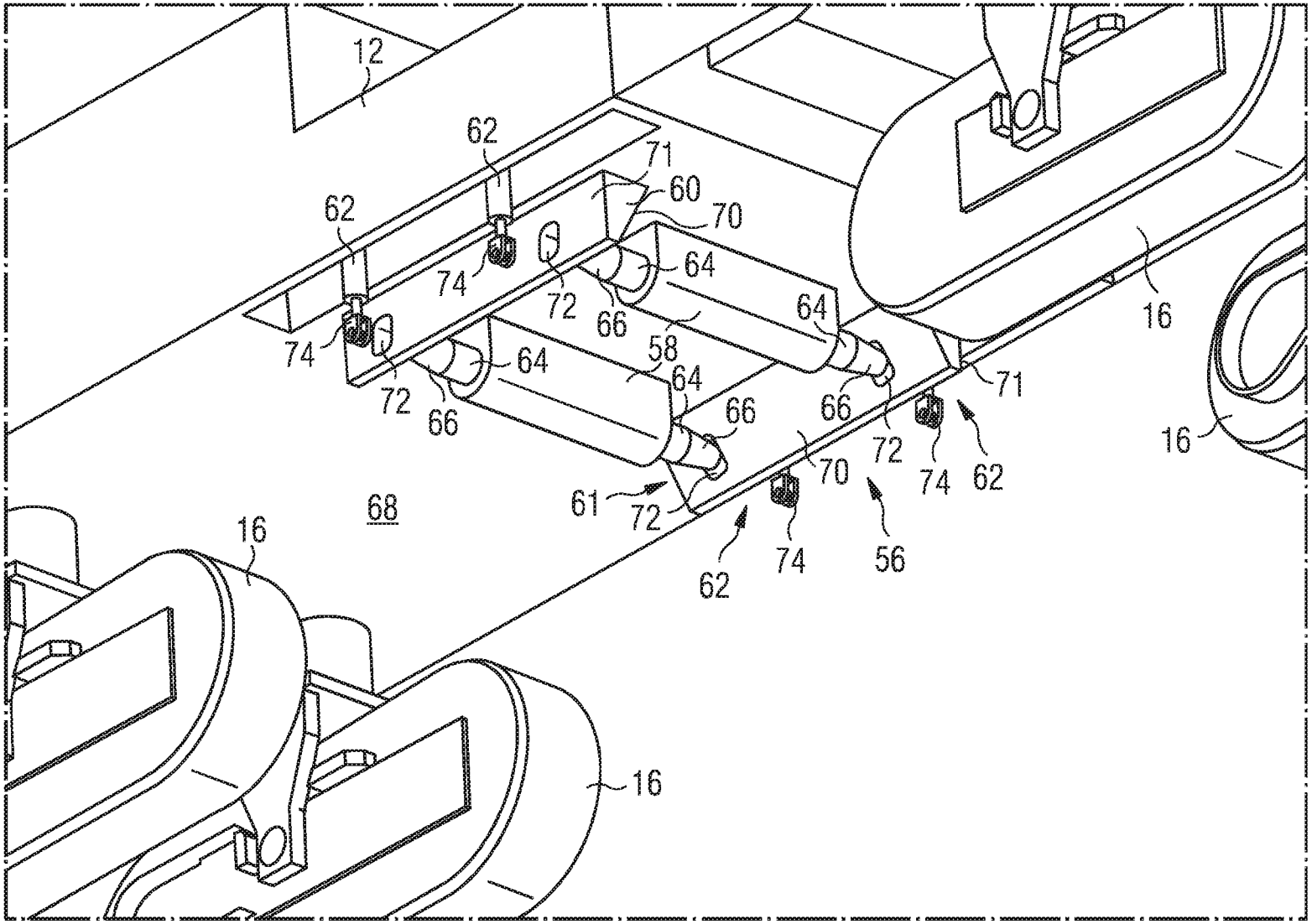
FIG. 3 is a perspective view of a schematic drawing of a frame portion from below, the frame portion being designed for mounting the milling assembly of FIG. 2, in accordance with the present disclosure.

Referring to FIG. 3, a perspective view of a mounting portion 56 for mounting the milling assembly 20 (not shown in FIG. 3) to the frame 12 from below is shown.

In the shown embodiment, the mounting portion 56 includes an actuator assembly 58 mounted below the frame 12, a third and fourth mounting unit 60 and 61, and four lifting actuators 62.

The actuator assembly 58 includes four movable locking rods 64 (shown in an extended position in FIG. 3) with conical locking rod ends 66. Two of the locking rods 64 are movable in a first direction perpendicular to the frame axis A (see FIG. 1), and the other two of the locking rods 64 are movable in a second direction opposite the first direction. In other embodiments, for example, the locking rods may be movable in any direction extending in a virtual plane that extends parallel to the frame axis A. Stated differently, the locking rods may be movable in a horizontal direction.

The conical locking rod ends 66 serve to provide a centering functionality for aligning and positioning the milling assembly 20 in the mounted state. In some embodiments, the centering functionality may be additionally or alternatively provided by inner circumferential faces of the mounting holes 52 (see FIG. 2) which may include a conical section for the same purpose.

It is noted that the actuator assembly 58 may be configured as one or more hydraulic actuators, electric actuators, pneumatic actuators, etc., or combinations thereof, each including one or more movable locking rods.

For example, a hydraulic cylinder assembly including one hydraulic cylinder only with at least one locking rod movable in the first direction, at least one locking rod movable in the second direction may be provided. The locking rods may extend out of the same hydraulic cylinder at opposing ends of the hydraulic cylinder. The locking rods may share a common hydraulic pressure chamber or may have individual hydraulic pressure chambers separate from each other or connected to each other. In another example, the actuator assembly 58 may include more than one hydraulic cylinder. Each hydraulic cylinder may include one movable piston only. The hydraulic cylinders may be grouped in pairs of two hydraulic cylinders having oppositely movable locking rods. The groups may be provided adjacent to one another in a direction along the frame axis A. In yet another example, the actuator assembly may include a hydraulic cylinder including more than one locking rod movable in the same direction. As one skilled in the art will appreciate, the above examples may be combined in an embodiment including, for example, two hydraulic cylinders, each being equipped with two movable locking rods.

The third and fourth mounting units 60 are formed as a wedge-shaped projections extending from a bottom face 68 of the frame 12 in a direction to the ground. The third and fourth mounting units 60, 61 are configured similar to the first and second mounting units 44, 46 so that inclined first faces 70 of the mounting units 60, 61 mate with the inclined second faces 50 of the mounting units 44, 46 (see FIG. 2). Specifically, the first face 70 of the third mounting unit 60 mates with the second face 50 of the first mounting unit 44, whereas the first face 70 of the fourth mounting unit 61 mates with the second face 50 of the second mounting unit 46. The inclined faces 50 and 70 cooperate to guide the milling assembly 20 into the proper mounting position that may be central to a width direction of the cold planer 10. Additionally, the mounting portion 56 and the milling assembly 20 may be provided with further guiding faces (not shown) arranged such that the milling assembly 20 is guided into the proper mounting position with respect to the frame axis A. The further guiding faces may be provided at additional mounting units, and/or at mounting units already provided for the guiding faces 50 and 70.

In some embodiments, the third and fourth mounting units 60 may include a plurality of second holes 72 aligned with the movable locking rods 64, and, in the mounted state of the milling assembly 20, aligned with the mounting holes 52. Again, the second holes 72 may be provided as throughholes extending between first and second faces 70, 71 of the respective third and fourth mounting units 60, 61, or as blind holes extending from the first faces 70 through a body portion of the respective mounting unit 60, 61.

For lifting the milling assembly 20, a plurality of (four in the shown embodiment) lifting actuators 62, for example hydraulic, pneumatic, and/or electric actuators, may be provided. The lifting actuators 62 are rigidly or pivotably connected to the frame 12, and include movable lifting rods 74 that can be attached to the piston pin receptions 54 of the milling assembly 20 (see FIG. 2). The lifting actuators 62 may vertical lift the milling assembly 20 or may lift the milling assembly 20 at an angle to the vertical. Further, in some embodiments, more or less than four lifting actuators may be provided, for example one lifting actuator only. The lifting actuator(s) may be center mounted or outboard, and/or may be symmetrical or unsymmetrical arranged and configured.

In other embodiments, the lifting actuators 62 may be omitted. In those embodiments, for example, the frame 12 may be lowered onto the milling assembly 20 positioned below the mounting portion 56 via the lifting columns 18 (see FIG. 1). As an alternative, the milling assembly 20 may be lifted by an external device for connecting the milling assembly 20 to the mounting portion 56. For example, the external device may be a movable transport carrier configured to move the milling assembly 20 over the ground prior to mounting the milling assembly 20 to the mounting portion 56, and after removing the milling assembly 20 from the mounting portion 56.

In some embodiments a sensor (not shown in the drawings) may be provided to generate a signal when the milling assembly 20 is in the lifted position, which is a position in which the locking rods 64 are substantially aligned with the mounting holes 52. The signal may be used as a starting signal for extending the locking rods 58 when the milling assembly has been lifted in place. For example, the sensor may be coupled with the lifting actuators 162. As another example, the sensor may be a tactile or contactless sensor mounted to the frame 12 or the milling assembly.

Figure 4:
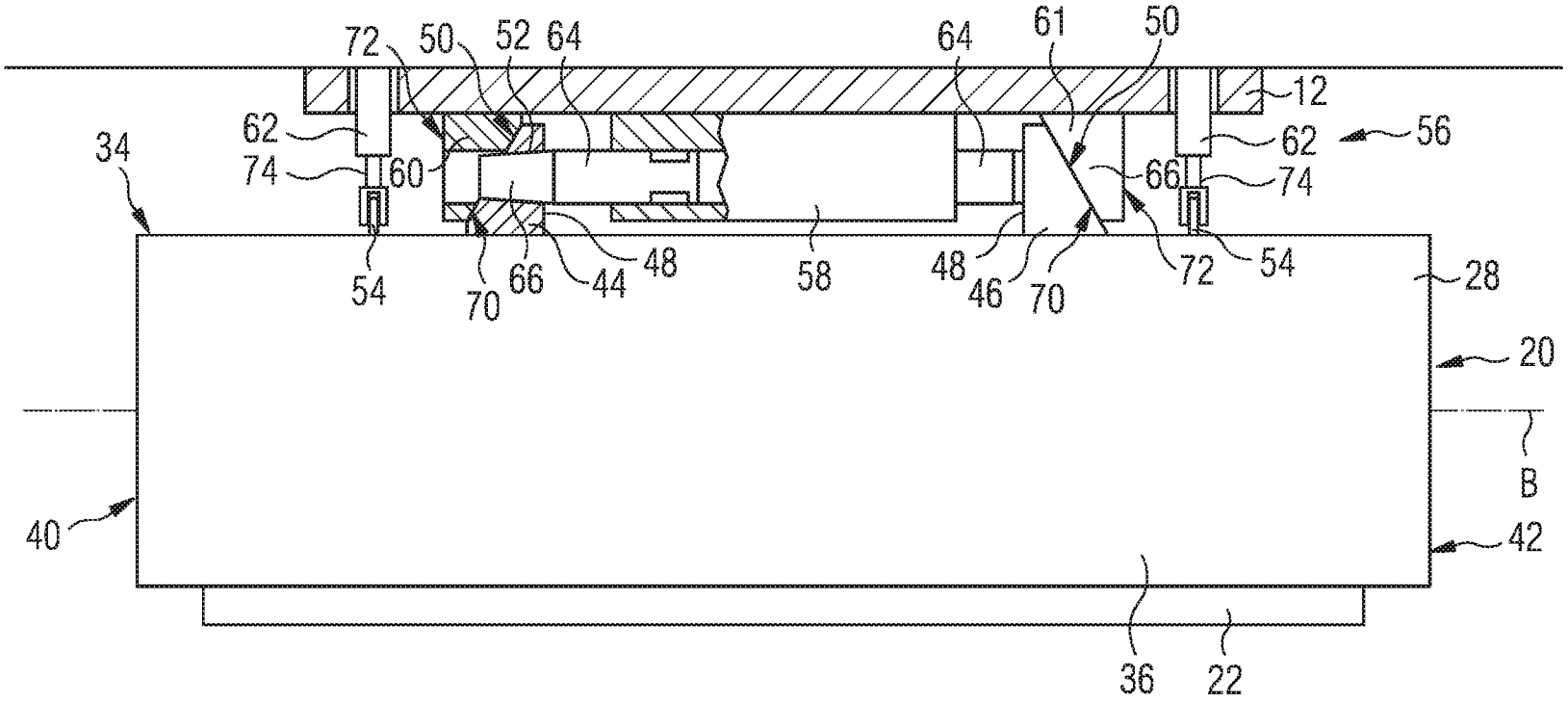
FIG. 4 is a schematic partial cut view through the frame of the cold planer showing the milling assembly of FIG. 2 and the frame of FIG. 3 in a mounted state, viewed in a direction along a frame longitudinal axis, according to the present disclosure.

Referring to FIG. 4, a situation in which the milling assembly 20 is mounted to the frame 12 is shown in a partial cut view. In the mounted state, the first faces 70 of the third and fourth mounting units 60, 61 contact the second faces 50 of the first and second mounting units 44, 46 to center the milling assembly 20 with respect to the mounting portion 56 in a width direction of the frame 12. Additionally, the locking rods 64, particularly the conical end sections 66, of the actuator assembly 58 are received in the mounting holes 52 to secure the milling assembly 20 in place. In other words, the locking rods 64 engage with the mounting holes 52 in the mounted state. Depending on the embodiment, the locking rods 64 may extend through the mounting holes 52 into the second holes 72, if provided, in a mounted state. The second holes 72 may be provided to serve as mounting holes to provide a supporting face for the locking rod end 66 similar to the mounting holes 52. Alternatively, the second holes 72 may be provided to provide a clearance space for a tip end of the extended locking rod end 66 as depicted in FIG. 4. The milling assembly 20 may be further hold in place by the lifting actuators 62 and their movable lifting rods 74.

Next, the milling drum 22 is operatively connected to the power source 14 to power the milling drum 22 during operation of the cold planer 10. For example, a quick connection system may be provided that may allow the milling drum 22 to (quickly) engage to belts, chains, or other mechanisms that cause the milling drum to rotate. The connection system may further allow to connect further systems disposed at the milling assembly 20, for example sensors, actuators, etc., with respective connections disposed at the frame 12 etc. engage with other actuators.

Figure 5:
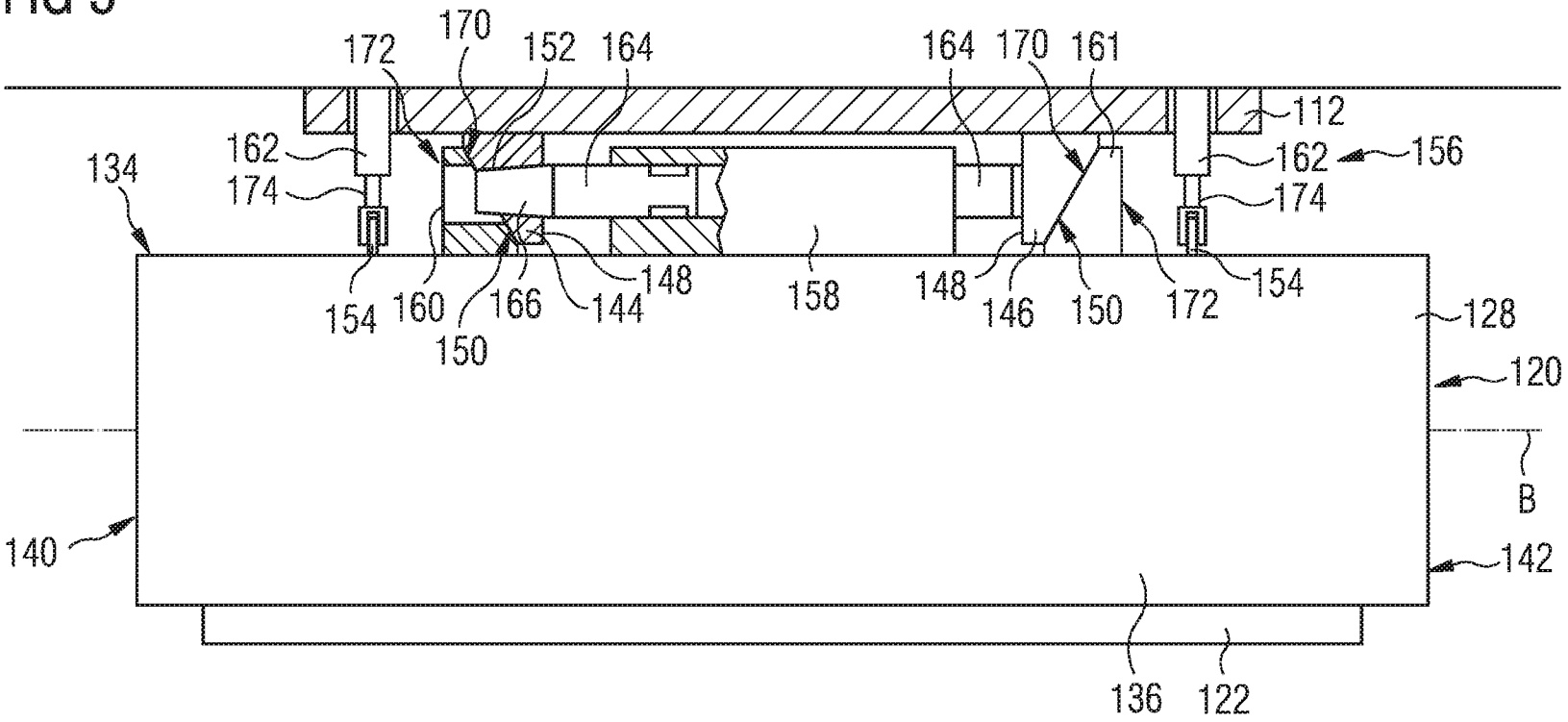
FIG. 5 is a schematic partial cut view through the frame of a cold planer in a mounted state of a milling drum assembly according to another embodiment, viewed in a direction along a frame longitudinal axis, according to the present disclosure.

Referring to FIG. 5, a situation in which a milling assembly 120 is mounted to a frame 112 of another embodiment is shown. The embodiment is an opposite embodiment to the embodiment discussed with reference to FIGS. 2 to 4. Similar parts are referred to with same reference signs in the one hundred's range. As one skilled in the art will appreciate, configuration and/or arrangement of those parts with same reference signs in the one hundred's range may correspond to each other. Furthermore, all kinds of conceivable modifications discussed with reference to the embodiment shown in FIGS. 2 to 4 may be correspondingly applicable to the embodiment shown in FIG. 5.

In the embodiment shown in FIG. 5, the actuator assembly 158 is fixed to the milling assembly 120. The first mounting holes 152 are provided in wedge-shaped mounting units 146 and 148 extending from the frame 112. Further wedge-shaped mounting units 160 and 161 extend in a radial direction from a top face 134 of a milling housing 128 accommodating a milling drum 122. The further mounting units 160 and 161 include holes 172 aligned with the first holes 152 and movable locking rods 158. The holes 172 may serve as mounting holes or as clearance holes. Again, the movable locking rods 164 of the actuator assembly 158 are movable in a horizontal direction and include conical end sections 166.

INDUSTRIAL APPLICABILITY

The milling assembly as disclosed herein is applicable as a milling unit of a ground milling machine. The milling assembly is particularly suitable as a milling unit of a cold planer for removing at least part of a surface of a paved area such as a road, bridge, and a parking lot. In some embodiments, the milling assembly as disclosed herein may be also applicable as a milling unit of a surface miner in surface mining applications, for example, for mining coal deposits in an open pit mine.

Terms such as "about", "around", "approximately", or "substantially" as used herein when referring to a measurable value such as a parameter, an amount, a temporal duration, and the like, is meant to encompass variations of ±10% or less, preferably ±5% or less, more preferably ±1% or less, and still more preferably ±0.1% or less of and from the specified value, insofar as such variations are appropriate to perform in the disclosed invention. It is to be understood that the value to which the modifier "about" refers is itself also specifically, and preferably, disclosed. The recitation of numerical ranges by endpoints includes all numbers and fractions subsumed within the respective ranges, as well as the recited endpoints.

Although the preferred embodiments of this invention have been described herein, improvements and modifications may be incorporated without departing from the scope of the following claims.

The invention claimed is:

1. A cold planer comprising:

a frame;

a milling assembly including a drum housing;

a locking mechanism for mounting the milling assembly to the frame;

a plurality of mounting units fixed to the drum housing for mounting the milling assembly to the frame, the mounting units including a plurality of mounting holes configured to connect to the locking mechanism, wherein the mounting holes include a conical portion, wherein the mounting units are formed as wedge-shaped protrusions extending from the drum housing and include a first face extending in a virtual plane substantially perpendicular to a housing axis of the drum housing, and an opposing second face extending non-parallel to the first face, the mounting holes extending from the first face, and wherein the mounting units are configured to mate with corresponding wedge-shaped protrusions on the frame, wherein the wedge-shaped protrusions on the frame include a first face extending in a virtual plane substantially perpendicular to a housing axis of the drum housing, and an opposing second face extending non-parallel to the first face such that the second face of the mounting units on the drum housing abut the second face of the wedge-shaped protrusion on the frame, and wherein the locking mechanism includes a plurality of movable locking rods having a conical end to mate with the conical portion of the mounting holes of mounting units.

2. The cold planer of claim 1, wherein the mounting holes extend along respective hole axes extending in a horizontal direction.

3. The cold planer of claim 1, wherein the plurality of mounting units include a first mounting unit arranged in a first half section of a face of the drum housing, and a second mounting unit arranged in a second half section of the face adjacent to the first half section in a direction along a housing axis of the drum housing.

4. The cold planer of claim 1, wherein the drum housing extends along a drum housing axis, and the mounting units extend from a top surface of the drum housing in a radial direction relative to the housing axis.

5. The cold planer of claim 1, wherein the mounting units extend from a top surface of the drum housing and are configured to mate with the corresponding wedge-shaped protrusions on the frame which extend from a bottom surface of the frame.

6. The cold planer of claim 5, wherein the mounting holes on the mounting units match with corresponding mounting holes located in the wedge-shaped protrusions on the frame.

7. The cold planer of claim 1, wherein the milling assembly includes a rotatable milling drum having a plurality of cutting tools disposed thereon.

8. A cold planer comprising:

a frame;

a milling assembly including a drum housing;

a locking mechanism for mounting the milling assembly to the frame;

at least one pin reception fixed to the drum housing;

a lifting actuator connected to the frame, the lifting actuator including a lifting rod which is attachable to the at least one pin reception to lift the drum housing toward the frame; and a plurality of mounting units fixed to the drum housing for mounting the milling assembly to the frame, the mounting units including a plurality of mounting holes configured to connect to the locking mechanism, wherein the mounting units are formed as wedge-shaped protrusions extending from the drum housing and configured to mate with corresponding wedge-shaped protrusions on the frame.

9. The cold planer of claim 8, wherein the mounting holes extend along respective hole axes extending in a horizontal direction.

10. The cold planer of claim 9, wherein the drum housing extends along a drum housing axis, and the mounting units extend from a top surface of the drum housing in a radial direction relative to the housing axis.

11. The cold planer of claim 10, wherein the mounting units extend from the top surface of the drum housing and are configured to mate with the corresponding wedge-shaped protrusions on the frame which extend from a bottom surface of the frame.

12. The cold planer of claim 11, wherein the mounting holes on the mounting units match with corresponding mounting holes located in the wedge-shaped protrusions on the frame.

* * * * *